US005271168A

United States Patent [19]

Wilson, Sr. et al.

[11] Patent Number: 5,271,168

[45] Date of Patent: Dec. 21, 1993

[54] PIPELINE PADDING MACHINE

[76] Inventors: Gilbert T. Wilson, Sr., 303 N. Jefferson, Robinson, Ill. 62454; R. David Sheehan, Jr., 64 E. Woodward Blvd., Tulsa, Okla. 74114

[21] Appl. No.: 914,308

[22] Filed: Jul. 17, 1992

[51] Int. Cl.[5] ..... E02F 5/22

[52] U.S. Cl. ..... 37/142.5; 405/179; 209/257; 209/260; 209/413; 209/420

[58] Field of Search ..... 405/179; 37/142.5; 209/240, 255, 260, 257, 404, 413, 420, 421

[56] References Cited

U.S. PATENT DOCUMENTS

| | | | |
|---|---|---|---|
| 2,814,387 | 11/1957 | McWilliams | 37/142.5 X |
| 3,701,422 | 10/1972 | Downey | 37/142.5 X |
| 4,256,572 | 3/1981 | Read | 209/257 |
| 4,633,602 | 1/1987 | Layh et al. | 209/420 X |
| 4,633,602 | 11/1991 | Layh et al. | 209/420 X |
| 5,106,490 | 4/1992 | McDonald | 209/257 X |
| 5,120,433 | 6/1992 | Osadchuk | 37/142.5 X |
| 5,183,160 | 2/1993 | McClain | 405/179 X |

FOREIGN PATENT DOCUMENTS

| | | | |
|---|---|---|---|
| 409659 | 1/1991 | European Pat. Off. | 209/257 |

*Primary Examiner*—Randolph A. Reese
*Assistant Examiner*—Arlen L. Olsen
*Attorney, Agent, or Firm*—Larson and Taylor

[57] ABSTRACT

A padding machine used for overlaying a pipeline disposed within a trench with sifted dirt to eliminate contact by rock or other abrasive material with the pipeline and, thereby, preclude rusting, corrosion or like damage. A trench typically lies along the edge of a right-of-way on which the padding machine travels, i.e. pulling, for example, as from a tractor. Raw filling material is introduced onto a shaker driven and/or vibrating screen through the use of, for example, a common backhoe. Rocks or larger sized particles move, by gravity, onto the right-of-way adjacent the side of the machine opposite to that of the trench, where sifted filler material passes onto and from a moving conveyor which is directed toward the desired covering relationship with the pipeline. A feature of the padding machine is the use of a boom which interconnects the freely vertical movable front end of the padding machine to a towing vehicle and includes an hydraulically operated piston for leveling purposes; i.e. maintains a constant distance between the bottom of the equipment and the ground surface irrespective of changes in terrain. Mechanism at the front end of the padding machine serves to control hydraulic and air functions and/or anything else required for effective operation, as conveyor speed, rate of machine movement, and the like.

5 Claims, 3 Drawing Sheets

PIPELINE PADDING MACHINE

BACKGROUND OF THE INVENTION

As is known, pipelines are in widespread use, serving to transmit various types of materials, including oil and/or gas, for example. In that the conventional pipeline is fabricated from metal, inherent problems are attributed to rusting, corroding, and the like. A need arises, therefore, in installing the pipeline in a manner so that the latter objections are overcome.

DESCRIPTION OF THE INVENTION

The invention serves to pad a pipeline to prevent rusting/corrosion by introducing sifted dirt and/or soil, which, importantly, is without rocks or abrasive components, around the pipeline.

In the usual laying procedure, a common ditching machine serves to provide a trench which might approximate 12 inches in width and a 36 inch to 48 inch depth. After pipeline placement, the instant padding machine is typically pulled along the pipeline containing trench by a tractor, for example, to seal or overlay the pipeline with selected padding material.

In other words, a principal concern is overlying the pipeline with a covering or padding material which serves to eliminate unwanted rusting and/or corrosion normally precipitated by damage from heavy rocks or the like.

DESCRIPTION OF THE FIGURES

A better understanding of the present invention will become more apparent from the following description, taken in conjunction with the accompanying drawings, wherein.

Figure 1:
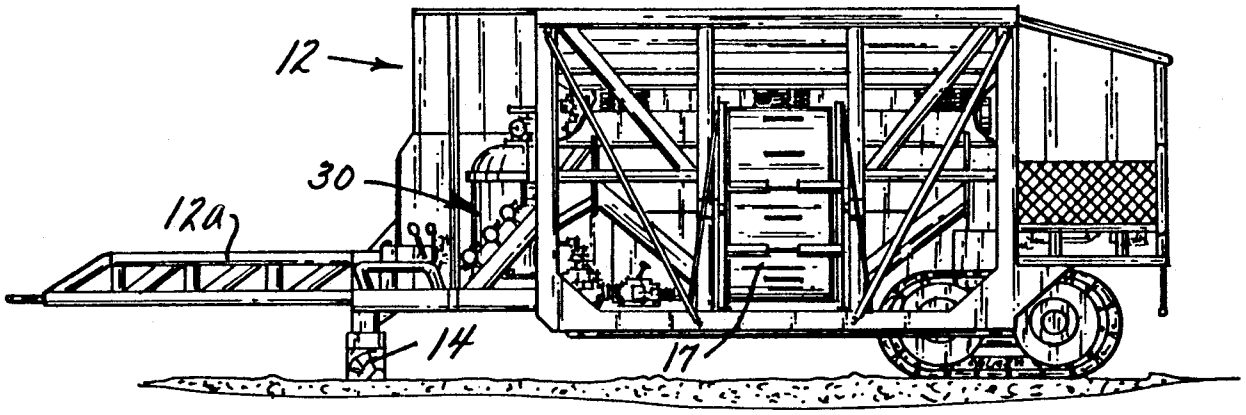
FIG. 1 is a side view, looking from the ditch side of the pipeline laying operation, of a padding machine in accordance with the teachings of the invention.
Figure 2:
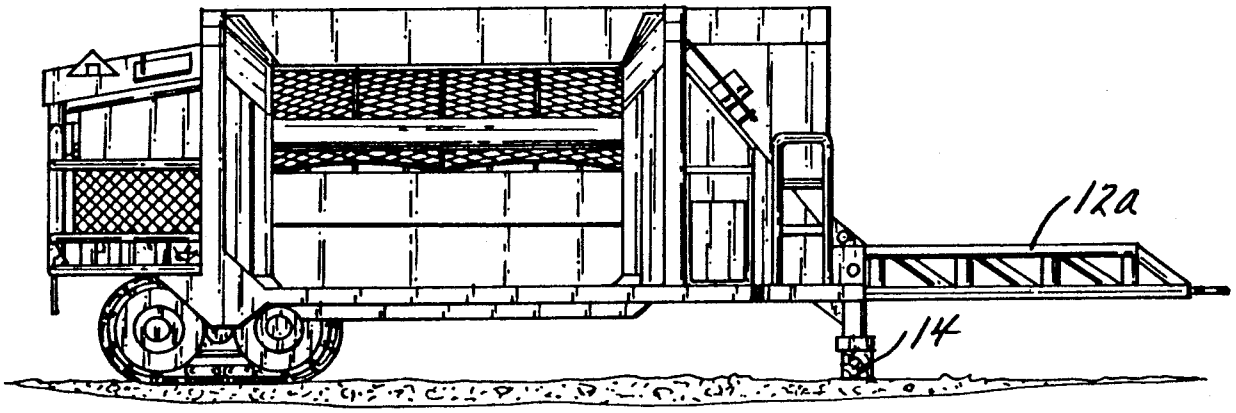
FIG. 2 is another view in side elevation, but, in this instance, looking from the opposite or right-of-way side of the machine presented in FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF A PREFERRED EMBODIMENT

In a typical approach for installing a pipeline, a conventional trench digger (not shown) is employed, resulting, as stated, in a trench which approximates 12 inches in width and from 36 inches to forty-eight inches in depth. The trench is typically along one edge of a right-of-way.

The padding machine 12, variously shown and detailed in the drawings herein, is typically pulled by a tractor (also not shown) secured to a forwardly extending boom 12*a*, illustrated in FIGS. 1, 2, 3 and 6.

Figure 6:
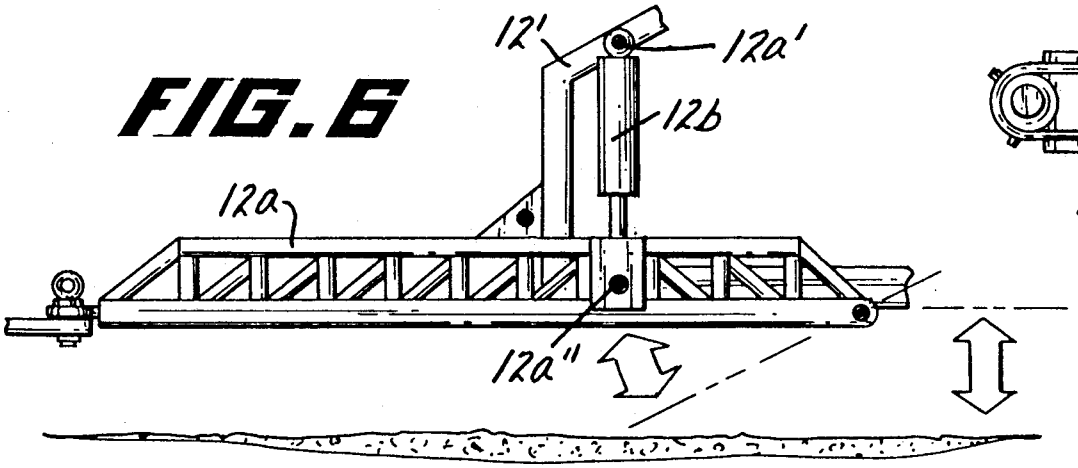
FIG. 6 is a view in side elevation detailing one arrangement of attaching the instant padding machine to a driving source.

As particularly evident in FIG. 6, the boom 12*a* is pivotally secured, at 12*a*', to framework 12' of padding machine 12. An important feature thereof is to maintain the padding machine 12 level, i.e. at a more or less constant distance from the ground, irrespective of the rise or fall of terrain.

The preceding is accomplished through the use of a leveling cylinder 12*b* extending between a portion of the framework 12' and a pivot 12*1*'' on the boom 12*a*. In that the aforementioned figures do not illustrate the tractor or other pulling vehicle, a concrete block 14, or the like, is used to temporarily position the padding machine 12 prior to hook-up for pulling.

Figure 9:
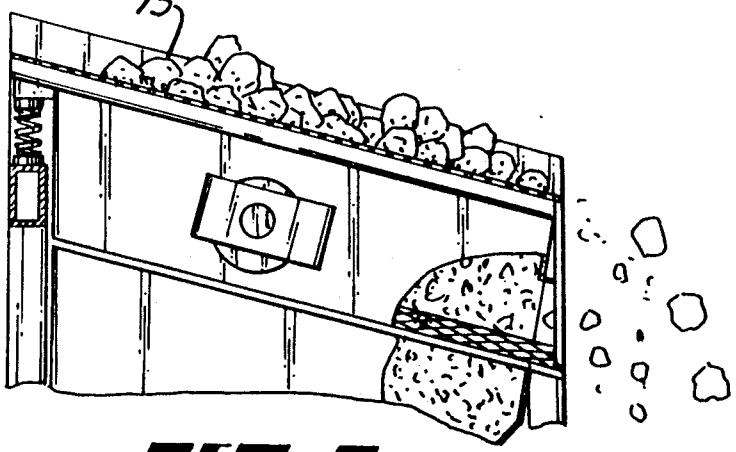
Figure 8:
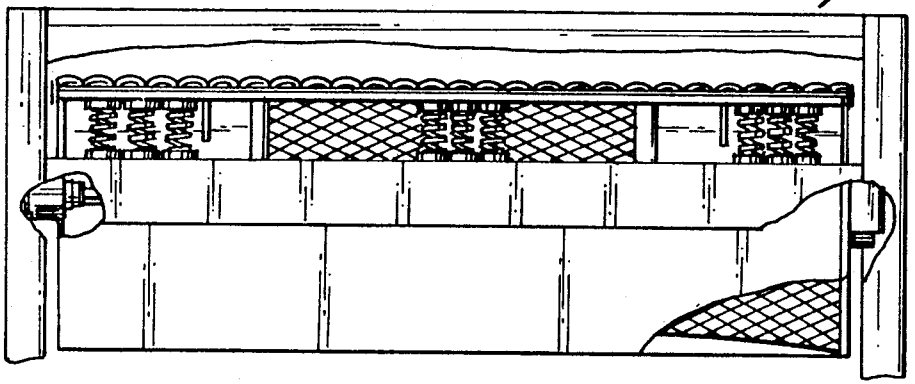
FIG. 8 is a view in rear elevation of a shaker head part of the invention; and, FIG. 9 is a view in side elevation further detailing head of FIG. 8.

While again not shown, the padding machine 12 of the invention is further used in connection with, for example, a backhoe, which serves to move the raw filling material, including rocks and other debris, onto an inclined screen 15 (see FIGS. 8 and 9).

The aforesaid screen 15 is caused to vibrate, by a shaker motor, through a preselected range and, being inclined (see FIG. 9), the rocks and other debris move by gravity away from the padding machine 12 and onto the right-of-way on which the padding machine 12 is traveling, i.e. on the side opposite to that of the trench. The shaker motor may be selectively reversed to achieve screen 15 cleaning.

Figure 7:
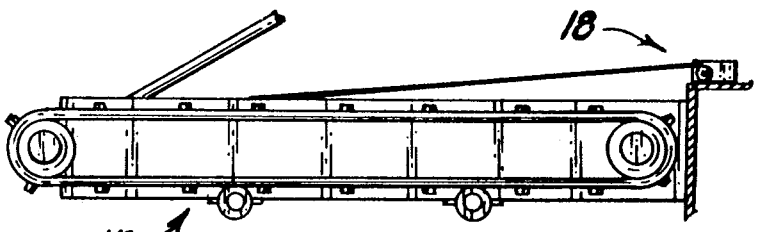
FIG. 7 is another view in side elevation, but in this instance detailing the ditch filling conveyor provided herein.

Only optimum size dirt or fill can pass onto and along winch controlled (for raising/lowering) conveyor 17, as shown in FIG. 7, i.e. to achieve pipeline coverage as the padding machine 12 moves alongside of the trench. The latter movement is under the control of an operator who oversees the padding results and instructs the driver of the towing vehicle to move forwardly, as required, as filling progresses, using the winch denoted 18, to lower the conveyor 11 to a functioning position (from a transporting position). Removable braces 17*a* serve to add strength to the conveyor 17 during use.

Figure 3:
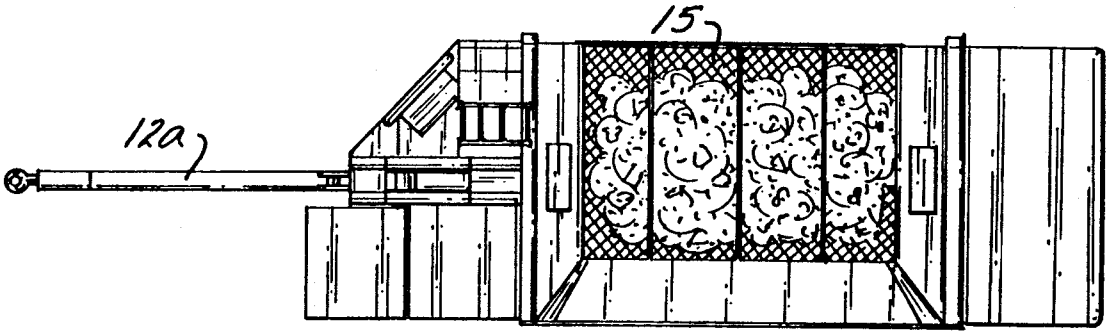
FIG. 3 is a top plan view of the instant padding machine.
Figure 4:
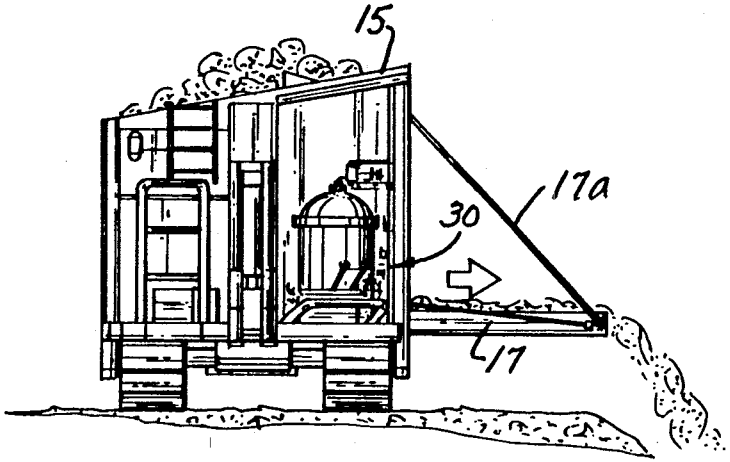
FIG. 4 is a view in front elevation of the padding of the invention.
Figure 5:
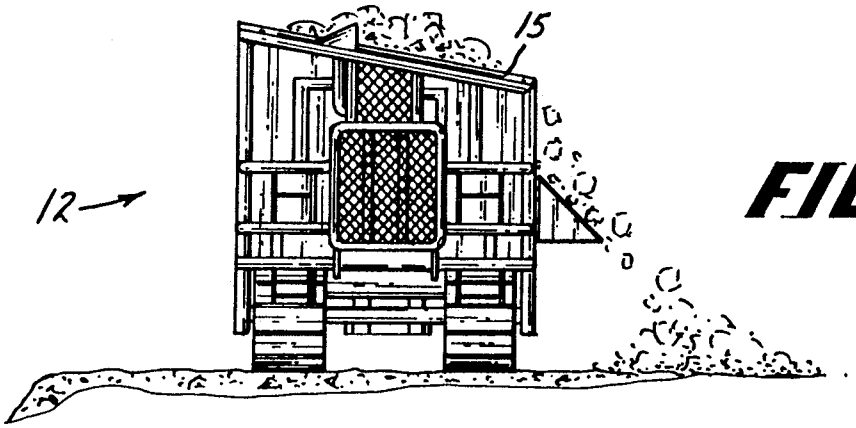
FIG. 5 is a view in rear elevation of the padding machine herein.

The aforedescribed filling by the instant padding machine 12 is quite apparent from the showings of FIGS. 3, 4 and 5. In FIG. 3, the unsorted raw filling material is shown on top of the screen 15, where the large or undesirable components of such fall, by gravity, from the padding machine 12 onto the right-of-way (note particularly FIG. 5). FIG. 4 demonstrates (see the arrow) the direction of the sifted fill material as it progresses away from the padding machine 12 and towards and into the trench containing the pipeline. A batter board (not shown) may be used to limit outward flow of the fill material.

As to powering the instant padding machine 12, such is typically accomplished by a hydraulic system (not detailed herein), where a control area 30 (also not detailed herein), located at the front of the padding machine 12, is controlled by an operator who visually observes and attends to controls, gauges and receivers for air and hydraulic systems, conveyor speeds, and other information necessary for effective padding operation.

As should be evident from the preceding, the padding machine of the invention effectively serves to overlay and/or pad a pipeline with sifted fill material to prevent damage to the latter. The machine is typically pulled by a tractor and involves also, typically, a backhoe for filler material loading.

The functional components are generally illustrated in the drawings, i.e. the screening or grid 15 which is inclined and which initially receives the raw filling material, and the winch 18 controlled conveyor 17, beneath the grid or screen 15, for disposing the sifted filling material into the aforesaid overlaying relationship with respect to the pipeline. Obviously, other structural arrangements for accomplishing the preceding are manyfold, and particular care has been taken to represent the principal components (and the function of each).

The pipeline padding machine described hereabove is susceptible, therefore, to many changes within the spirit of the invention, including, by way of example, in proportioning; relocation of the control area; the precise manner of assembly; and, the like. Thus, the preceding should be considered illustrative and not as limiting the scope of the following claims:

We claim:

1. A padding machine movable along a right-of-way including a trench disposed proximate a longitudinal edge portion of the right-of-way and a source of filling material, said padding machine comprising a framework, a screen, mounted on said framework and inclined downwardly in the direction of said right-of-way opposite to that of said trench, for selectively receiving and screening filling material, means for shaking said screen to produce shifted filling material, a conveyor, disposed beneath said screen for, in use, introducing the sifted filling material passing through said screen into the trench so as to selectively cover a pipeline disposed at the bottom of the trench, a boom means, extending from the front of said framework in the direction of movement of said padding machine, for attachment of the padding machine to a towing vehicle, and mounting means having a first end connected to the boom means and a second end connected to the framework for mounting said boom means on said framework in a manner tending to maintain a constant level of said padding machine irrespective of changes in terrain.

2. The padding machine of claim 1 where said front of said framework is freely movable in an upward and downward direction absent connection of the boom means to a towing vehicle.

3. The padding machine of claim 2 where said mounting means for of said boom means includes hydraulic means for selectively controlling the vertical position of said padding machine.

4. The padding machine of claim 3, wherein said hydraulic means comprises a leveling cylinder.

5. The padding machine of claim 1 wherein said conveyor extends outwardly from the side of the machine and is pivotable between a first, functional position and a second, transporting position and said machine includes a selectively controlled winch for raising and lowering the conveyor between said first and second positions.

* * * * *